United States Patent [19]

Carriveau

[11] Patent Number: 4,483,315

[45] Date of Patent: Nov. 20, 1984

[54] FIREPLACE CHIMNEY CAP AND DAMPER COMBINATION

[76] Inventor: Thomas Carriveau, 11359 Grand Oak, Grand Blanc, Mich. 48439

[21] Appl. No.: 337,703

[22] Filed: Jan. 7, 1982

[51] Int. Cl.[3] ..... F23L 3/00

[52] U.S. Cl. ..... 126/286; 126/289; 98/59

[58] Field of Search ..... 126/285 R, 286, 288, 126/289, 293, 312, 307 R; 98/58, 59, 60; 110/163

[56] References Cited

U.S. PATENT DOCUMENTS

| | | | |
|---|---|---|---|
| 164,712 | 6/1875 | Bowman | 126/285 R |
| 3,377,939 | 4/1968 | Sailors | 98/59 |
| 4,165,679 | 8/1979 | Lyemance | 126/286 |
| 4,250,801 | 2/1981 | Boidron | 98/59 |
| 4,256,257 | 3/1981 | Pinkerton | 98/59 |
| 4,368,663 | 1/1983 | Tabacco | 98/59 |

FOREIGN PATENT DOCUMENTS

| | | | |
|---|---|---|---|
| 71882 | 12/1950 | Denmark | 98/59 |
| 39487 | 4/1886 | Fed. Rep. of Germany | 98/59 |
| 657943 | 5/1935 | Fed. Rep. of Germany | 98/59 |
| 988758 | 4/1951 | France | 98/59 |

*Primary Examiner*—James C. Yeung
*Attorney, Agent, or Firm*—Harry R. Dumont

[57] ABSTRACT

A chimney cap pivotally mounted at one end to allow secure closure of the cap or opening for operation. The lower end of the chimney is connected to a fireplace which has its own manually operated damper. The chimney cap is operable conjointly with the damper or separately by its own operating apparatus.

7 Claims, 5 Drawing Figures

3
2
24
22
19
20
44
14
18
16
26
32
30
28
46
12
10
34
36
38
40
42
47
50
52
48
4
5

FIREPLACE CHIMNEY CAP AND DAMPER COMBINATION

BACKGROUND OF THE INVENTION

This invention relates to an energy saving cap to be used in connection with a chimney for stoves or fireplaces. A major problem in operating such heating devices is the loss of hot air from the room and indeed from the entire dwelling both during and after heating operation. Most chimneys have their own damper or damper plate which may be manually opened when a fire is lit or closed afterwards to provide some measure of sealing effect against the loss of hot air from the dwelling. However, the seal provided by damper plates is generally ineffective and the damper plate itself by reason of its proximity to the fire becomes warped in use so that heat loss becomes considerable in the closed position as well as the open position of the damper plate.

The present invention relates to a chimney cap that is positioned at the top of the chimney remote from the fire and closable independently of the operation of the damper, if desired.

SUMMARY OF THE INVENTION

The present invention thus relates to an improved energy saving chimney cap that seals the chimney opening at its top in a highly efficient manner. In periods when the fireplace and chimney are not in use, annoying drafts and loss heat are prevented. In addition, the chimney cap can be used when necessary to seal out animal and insect pests and to seal out wind, rain and snow and particularly inclement weather.

BRIEF DESCRIPTION OF THE DRAWINGS

The present invention will now be explained in the accompanying specification and in the drawings in which like numerals are used to refer to like elements as they appear in the several different views and in which.

DETAILED DESCRIPTION OF THE PREFERRED EMBODIMENT

Figures 1, 2, 3, 4, 5:
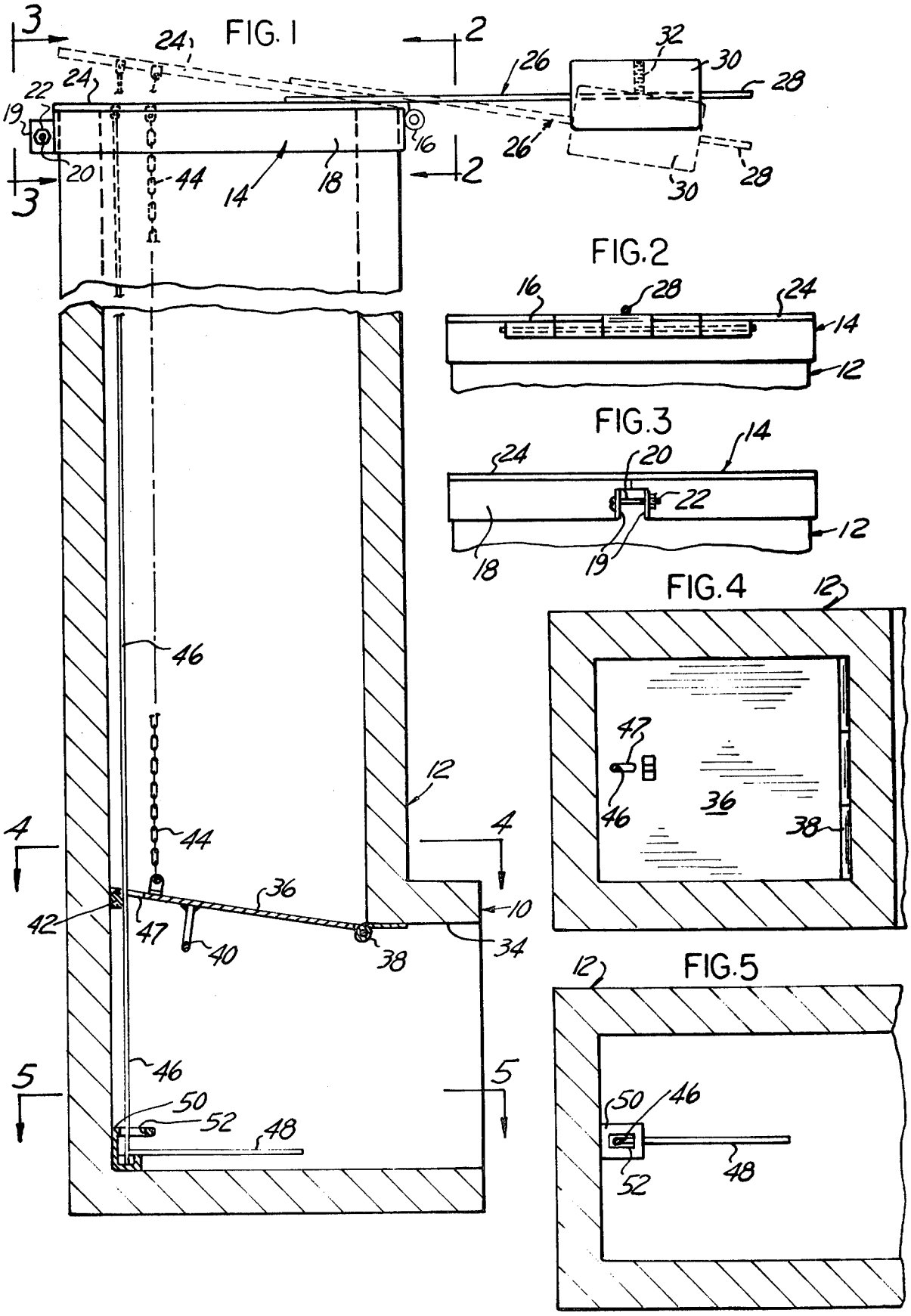
FIG. 1 is a fragmentary vertical sectional view showing the chimney cap and its operating parts as mounted in a fireplace chimney installation.
FIG. 2 is a right side view taken along the section line 2—2 of FIG. 1 with parts broken away showing the chimney cap.
FIG. 3 is a left side elevational view taken along the line 3—3 of FIG. 1 showing the end of the chimney cap.
FIGS. 4 and 5 are horizontal cross-sectional views taken along the section lines 4—4 and 5—5, respectively, showing the operating parts at the base of the chimney which control the chimney cap and damper.

FIG. 1 shows the fireplace 10 and the chimney 12 extending from its top to and beyond the roof of the building. The cap 14 is shown seated on the top of the chimney 12 and snugly fitting about it in a closed position. The cap 14 is pivotally mounted on the chimney 12 by a hinge 16. The hinge 16 is of the piano hinge type as better shown in FIG. 2. The sides of the cap 14 are fabricated from a band of metal 18 which has its free ends joined at the left hand side of the cap 14 by a pair of end bend portions 19 having opposed openings and a nut 20 and bolt 22 as best shown in FIG. 3. The flat top of the cap 14 is provided by a plate 24 fixed to the band 18 by welding or other fastening means. It will be understood that the cap 14 can be formed from a number of different materials and by divers means of manufacture so long as it comes in tight sealing engagement with the upper open end of the chimney 12 in its closed position.

A counter balancing means 26 is connected to the top 24 of the cap 14. It includes a side shaft 28 and a weight 30 slidably mounted on the shaft 28. Connection between the two elements is preferably by means of a threaded fastener 32 which permits tightening and loosening of the connection between the shaft 28 and the weight 30 so that the amount of counter balancing can be selectively adjusted in use.

The basic elements shown in the fireplace 10 are its front opening 34 and an internal damper 36 which is hinged about a pivotal mounting 38. A downwardly extending handle 40 is connected to the lower surface of the damper 34 to allow for its clockwise pivotal opening between a closed position as illustrated and an open position. An abutment 42 is provided at the rear of the fireplace 10 to support the left hand end of the damper 36 in its closed position.

A chain 44 is shown connected between the upper surface of the damper plate 36 and the lower surface of the top 24 of the chimney cap 14. The chain 44 permits the conjoint operation of damper 36 and cap 14. Because of the tendency of the counter balancing mechanism 26 to place the cap 14 in an open position, as soon as the damper plate 36 is raised upwardly to open it, the chimney cap 14 will rise along with the upward end of the chain 44 so both damper 36 and chimney cap 14 are in an open position permitting use of a fireplace fire.

Because of the problems that exist with dampers, it may be desirable to adjust the chimney cap 14 to a closed position regardless of the condition of the damper 36. For this purpose there is provided a vertical rod 46 which has its upper end connected to the cap 14 and its lower end connected to an operating handle 48 that extends laterally from it to permit its being grasped and moved between an upper opening position and a lower closing position. Thus, regardless of the positioning or operation of the damper plate 36 there may be provided a secure closure of the chimney through the chimney cap 14. A latching mechanism is provided at the lower end of the rod 46 cooperable with a latching mechanism. The latching mechanism includes a bracket 50 having an upper opening 52 which allows lateral movement of the operating handle 48 but retrains it against opening beyond the limit to upper travel provided by the bracket 52.

In FIG. 1, the several parts are shown in solid line designation with the operating rod positioned to securely close the chimney cap 14. The parts are shown in their open position for cap 14 in dash line configuration.

FIG. 4 shows the manner in which the vertical rod 46 extends through an opening 47 left to permit its passage through the damper plate 36 to independently open and close the cap 14.

FIG. 5 further shows the upper limiting bracket and opening 52 which is used to provide a limit to the upper travel and opening of the chimney cap 14. The extent of travel of the cap 14 to its open position is preferably limited in the manner shown. This will provide sufficient egress to the smoke but will still control the outflow of heated air to an extent that will be very helpful in restraining cooling of the building below.

It will thus be seen that I have provided by my invention, a device that is important in conservation of energy and heating of buildings, particularly those which are equipped with fireplaces, parlor stoves and the like. Independent or conjoint control of the cap is available along with the damper movement. The upper limit of travel of the chimney cap is also controllable in a positive manner that provides the best possible size opening from the upper end of the chimney.

I claim:

1. In a chimney cap device for a chimney mounted on a fireplace and having a damper plate movable between relatively open and closed positions in the lower end of said chimney, the combination comprising:

a pivotal mounting for said cap on one side of the upper open end of said chimney;

a vertically oriented operating rod connected to said cap for pivotally moving it between closed and open positions;

an opening formed through said damper plate to allow passage of said rod therethrough for operation of said cap relative to said damper plate and to pass a limited hot air flow therethrough in both positions of said damper plate; and a flexible means connecting said damper plate and said cap for providing movement between aforesaid open and closed positions.

2. The combination as set forth in claim 1 wherein said cap includes a metal band fitted about the sides of said chimney open end and wherein a top plate is fixed to said band.

3. The combination as set forth in claim 2 in which said band includes a pair of free end bend portions, each having an opposed opening therethrough, and an adjustable fastening means is connected through said openings for adjusting the cap fit to said chimney open end.

4. The combination as set forth in claim 3 in which said fastening means comprises a bolt and a nut threaded thereon for ready adjustment.

5. The combination as set forth in claim 1 in which a latch mechanism is fixed to said chimney wall below said damper plate for limiting the upper movement of said cap and for retaining it in an open position.

6. The combination as set forth in claim 5 in which said latch mechanism includes a plate having an opening extending through it and in which the lower end of said rod includes a forwardly bent handle portion.

7. The combination as set forth in claim 1 in which a weight is mounted on the top of said cap for stabilizing it in its open position.

* * * * *